United States Patent [19]

Grosz et al.

[11] Patent Number: 5,067,633

[45] Date of Patent: Nov. 26, 1991

[54] DISPOSABLE PLASTIC CUP DISPENSER WITH SPRING

[75] Inventors: Edward G. Grosz, Sodus Point; Fox J. Herrington, Holcomb; Eric A. St. Phillips, Fairport, all of N.Y.

[73] Assignee: Mobil Oil Corporation, Fairfax, Va.

[21] Appl. No.: 281,597

[22] Filed: Dec. 9, 1988

[51] Int. Cl.[5] ..... B65G 59/00

[52] U.S. Cl. ..... 221/279; 221/282; 221/307

[58] Field of Search ..... 221/310, 307, 303, 45, 221/56, 58, 59, 63, 155, 279, 282; 312/71, 43

[56] References Cited

U.S. PATENT DOCUMENTS

| | | | |
|---|---|---|---|
| 1,201,963 | 10/1916 | Hill | 221/310 X |
| 1,207,092 | 12/1916 | Sullivan | 221/307 X |
| 3,069,048 | 12/1962 | Easton et al. | 221/63 X |
| 3,164,298 | 1/1965 | Repko | 221/303 |
| 4,033,478 | 7/1977 | House | 221/279 |
| 4,199,076 | 4/1980 | Brown | 221/59 X |
| 4,228,918 | 10/1980 | Kellogg | 221/310 X |
| 4,298,139 | 11/1981 | Radek | 221/198 |
| 4,298,142 | 11/1981 | Stanley | 221/310 X |
| 4,482,080 | 11/1984 | Pawlowski et al. | 221/310 |
| 4,520,946 | 6/1985 | Gould et al. | 221/63 |
| 4,767,022 | 8/1988 | Oldorf | 221/282 X |

*Primary Examiner*—David H. Bollinger

*Attorney, Agent, or Firm*—A. J. McKillop; C. J. Speciale; M. J. Mlotkowski

[57] ABSTRACT

A disposable plastic cup dispenser incorporating a spring for imparting biasing action to a stack of nested cups in the dispenser so as to render the cups available for individual and discrete dispensing thereof. The spring is in a compressed condition and extends intermediate the inner bottom wall surface of the container and the bottom of the lowermost cup of the stack of cups, thereby biasing the stack of cups towards a discharge or dispensing opening formed in the opposite end of the housing through which the endmost cup of the stack partially protrudes.

10 Claims, 1 Drawing Sheet

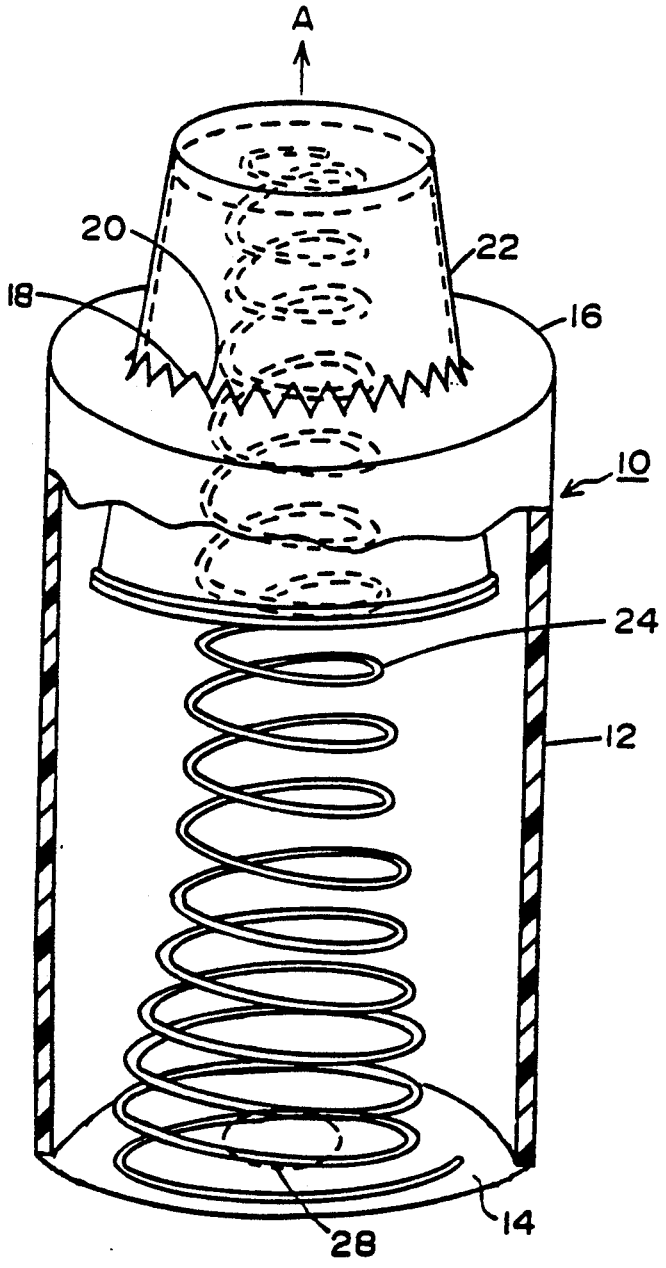
A
20
22
18
16
10
24
12
14
28

DISPOSABLE PLASTIC CUP DISPENSER WITH SPRING

BACKGROUND OF THE INVENTION

1. Field of the Invention

The present invention relates to a cup dispenser and, more particularly, pertains to a disposable plastic cup dispenser incorporating a spring for imparting biasing action to a stack of nested cups in the dispenser so as to render the cups available for individual and discrete dispensing thereof.

In essence, the utilization of cup dispensers of various types for the individual or discrete dispensing of cups from a stack of nested cups is well known in the technology; and in general, contemplates the provision of a housing or cylindrical receptacle containing a stack of such cups in a nested relationship with an opening being formed at one end of the receptacle through which there partially protrudes the endmost cup of the stack, and which is enabled to be individually separated from the remaining stack of cups through the exertion thereon of an axial pull tending to discharge the cup through the receptacle opening.

Basically, cup dispensers of the type under consideration are of a generally complex and resultingly expensive construction, which renders their applications to so-called "throw-away" or disposable cup dispensing uses rather uneconomical.

The present invention is directed towards the provision of an extremely simple and inexpensive disposable plastic cup dispenser, in which a spring member is arranged within a substantially cylindrical housing containing a stack of nested cups in an inverted position. The spring is in a compressed condition and extends intermediate the inner bottom wall surface of the container and the bottom of the lowermost cup of the stack of cups, thereby biasing the stack of cups towards a discharge or dispensing opening formed in the opposite end of the housing through which the endmost cup of the stack partially protrudes. Upon the endmost cup being withdrawn from the stack, such as by the exertion of an axial pull thereon tending to have a beaded rim at its larger open end pass through the opening in the housing, the spring will cause the stack to be biased upwardly towards the opening so as to position the next cup in the stack into a condition for dispensing thereof.

2. Discussion of the Prior Art

Although various dispensers for cups and the like are currently available in which resilient members or springs are adapted to exert biasing forces to advance the cups for individual dispensing from a stack of nested cups, the dispenser structures, in general, are rather complex, causing dispenser systems of that kind to be expensive and not particularly adapted for "throw-away" or disposable application.

Brown U.S. Pat. No. 4,199,076 discloses a cup dispenser in which a housing incorporates a helical compression spring exerting a compressive biasing force against a stack of nested cups through the interposition of a plate which is axially displaceable within the housing while being guided along a plurality of longitudinal guide ribs. This structure is relatively complex and expensive inasmuch as it necessitates the provision of the guide ribs, the separate cup-supporting plate and the helical spring acting thereon. Consequently, a cup dispensing package of that type is rather expensive from the standpoint of producing a disposable or single-use plastic cup dispenser system.

House U.S. Pat. No. 4,033,478 discloses a cup dispenser including a tubular container having a longitudinally extending coil spring arranged therein which acts to exert axial pressure against a cup-shaped member which will tend to bias stack of nested cups towards a dispensing opening formed at the end of the container, and wherein the cups are restrained within the opening by means of a plurality of resilient finger members projecting radially inwardly. Although this is a simpler construction than Brown, it still necessitates a plurality of components rendering the structure uneconomically expensive from the standpoint of providing a disposable cup dispenser system.

Radek U.S. Pat. No. 4,298,139 discloses a dispenser for disposable cups which are initially stacked in a flattened condition, and wherein a spring pressure against the end of the stack of the cups tending to bias the cups outwardly of the dispenser so as to be retrievable in individual units and then manually expanded for drinking purposes.

SUMMARY OF THE INVENTION

Accordingly, the present invention has as its primary object the provision of a simple and disposable plastic cup dispensing arrangement in which a coil spring member, which may be formed from a rigid polystyrene strip, has one end thereof acting to be supported against the bottom of a generally rigid tubular container, and wherein the opposite end of the spring member exerts an axial biasing force against the inside of the lowermost cup of an inverted stack of cups, causing the cups to be continually advanced towards a discharge opening in the container. The filling condition of the container may be readily ascertainable by rendering the material of the tubular container transparent in nature, with the entire remaining structure being discardable and replaceable by a full cup dispenser arrangement.

Moreover, the outer end surface of the container which is distant from the cup dispensing opening may be provided with an adhesive tab member, normally covered by a release paper prior to its use, as to enable the cup dispenser arrangement to be adhered to any expedient horizontal support surface, such as a counter or table top.

The entire dispenser arrangement may be encompassed by a bag-shaped heat-shrinkable thermoplastic film.

BRIEF DESCRIPTION OF THE DRAWING

Reference may now be had to the following detailed description of an exemplary embodiment of the inventive cup dispenser, taken in conjunction with the accompanying single figure of drawing showing a generally perspective side view of a plastic cup dispenser, illustrated partly in section.

DETAILED DESCRIPTION

Referring now to the single figure of drawing, the cup dispenser arrangement 10 includes a housing consisting of a generally tubular member 12, preferably constituted from a rigid polystyrene material which, if desired, may be transparent in nature so as to provide visual inspection of its contents, and having a closed bottom end, possibly by the insertion therein of a thermoformed cap or plug member 14. The opposite end portion 16 of the tubular member 12 may be crimped so as to extend radially inwardly and form an opening 18 provided with a serrated annular edge 20 which renders the opening 18 flexible in its size. A stack of nested cups 22 in an inverted position is arranged within the container 12 such that the endmost cup partially protrudes through the opening 18, with the diameter of the opening being such as to be somewhat smaller than the larger open end of the cup, thereby causing the cup to normally be restrained in position within the opening 18 of the container.

A helically coiled and axially extended element forms a spring 24 which is preferably constituted from a substantially rigid but resilient polystyrene material, imparts an axial biasing force between the bottom 14 of the container 12 and the bottom of the lowermost cup within the stack of cups, thereby continually biasing the stack of cups towards the opening 18 so as to maintain the cups of the stack in readiness for individual or discrete dispensing. Consequently, upon withdrawing the endmost cup which protrudes through the opening 18; in effect, by exerting an axial pull thereon in the direction of arrow A, and past serrated flexible edge 20, thereby separating the cup from the remainder of the stack, the biasing action of the spring 24 will cause the next cup in the stack of cups to assume its position within the opening 18 of the container gripped by the serrated edge 20.

Moreover, in order to be able to firmly position or anchor the entire cup dispenser arrangement 10 on a table top or any suitable horizontal surface, the external bottom surface the container 12 may be equipped with an adhesive tab 28 which prior to use is normally covered by a release paper (not shown), which is separated therefrom so as to enable the container to be adhesively fastened to a surface on which it is supported.

The entire cup dispensing container structure may be provided with suitable indicia or decorative legends which are imprinted or embossed thereon, as is well known in the art. Moreover, in order to maintain the entire cup dispenser package in a closed or sealed condition, the stack of cups and dispenser container may be encompassed in a heat-shrinkable thermoplastic bag, preferably constituted from a polyethylene film or the like.

From the foregoing, it becomes readily apparent that the entire arrangement consisting of the dispenser container, plastic spring and cups is of an extremely simple and inexpensive construction thereby rendering the cup dispenser economical from the viewpoint of single-use or so-called "throw-away" operation.

While there has been shown and described what is considered to be a preferred embodiment of the invention, it will, of course, be understood that various modifications and changes in form or detail would readily be made without departing from the spirit of the invention. It is therefore intended that the invention be not limited to the exact form and detail herein shown and described, nor to anything less than the whole of the invention herein disclosed as hereinafter claimed.

What is claimed is:

1. A disposable cub dispenser for the packaging and discrete individual dispensing of cups from a stack of inverted nested cuts each of which has a tapered sidewall, a bottom wall at the smaller end thereof and an open top encompassed by an outer beaded rim structure; said dispenser comprising a generally vertically oriented tubular member having a peripheral sidewall structure, a bottom wall and a top wall, said top wall being a radially inwardly crimped portion of said peripheral wall structure forming an aperture with a serrated resilient annular edge, a portion of the endmost cup of the stack of cups protruding upwardly through said aperture in engagement with said serrated edge, said serrated edge being radially resiliently widenable in response to an upward pull being exerted upon said endmost cup to facilitate passage therethrough and separation from the remainder of said stack of cups; and means in said tubular member for exerting an axial biasing force on said stack of cups to position the remaining cups of said stack in readiness for dispensing a successive cup from said aperture, wherein said biasing means comprises a helical compression spring axially extending between the lowermost cup of said stack of cups and the bottom wall of said tubular member, said helical compression spring having one end contacting the inner surface of the bottom wall of said tubular member and an opposite end contacting the bottom wall of the lowermost cup of said stack of cups.

2. The cup dispenser as claimed in claim 1, wherein said helical compression spring is constituted from a rigid, resilient polystyrene material.

3. A cup dispenser as claimed in claim 1, wherein adhesive means are provided on the external bottom surface of said tubular member for adhesively attaching said dispenser in an upstanding orientation to an essentially horizontal support surface.

4. A cup dispenser as claimed in claim 3, wherein said adhesive means comprises an adhesive tab member which is normally covered by a release paper prior to adhesion to said support surface.

5. A cup dispenser as claimed in claim 1, wherein said dispenser is constituted of a generally rigid polystyrene material.

6. A cup dispenser as claimed in claim 5, wherein said polystyrene is transparent to facilitate viewing of the contents of said dispenser.

7. A cup dispenser as claimed in claim 1, wherein a heat-shrinkable plastic film material sealingly encompasses the dispenser and a stack of said nested cups.

8. A cup dispenser as claimed in claim 1, wherein a thermoplastic bag encompasses said dispenser and a stack of nested cups.

9. A cup dispenser as claimed in claim 8, wherein said bag is constituted from a polyethylene film.

10. A cup dispenser as claimed in claim 1, wherein product-identifying legends, indicia and ornamental imprinting or embossing are provided thereon.

* * * * *